US005625339A

United States Patent [19]

Zarembo et al.

[11] Patent Number: 5,625,339

[45] Date of Patent: Apr. 29, 1997

[54] APPARATUS FOR CHANGING THE STATUS OF MAGNETIC MARKERS IN AN ELECTRONIC ARTICLE SURVEILLANCE SYSTEM

[75] Inventors: Peter J. Zarembo, Shoreview; Philip E. Edstrom, Minneapolis; Anthony M. Belka, Stillwater; Dennis L. Sando, Minneapolis; William R. Weber, III, Vadnais Heights; Mark R. Crellin, St. Paul, all of Minn.

[73] Assignee: Minnesota Mining and Manufacturing Company, St. Paul, Minn.

[21] Appl. No.: 583,925

[22] Filed: Jan. 11, 1996

[51] Int. Cl.[6] ..... G08B 13/187; H01F 13/00

[52] U.S. Cl. ..... 340/551; 335/284

[58] Field of Search ..... 340/551; 335/284

[56] References Cited

U.S. PATENT DOCUMENTS

| | | | |
|---|---|---|---|
| 4,499,444 | 2/1985 | Heltemes et al. | 335/284 |
| 4,684,930 | 8/1987 | Minasy et al. | 340/551 |
| 4,689,590 | 8/1987 | Heltemes | 335/284 |
| 4,752,758 | 6/1988 | Heltemes | 335/284 |
| 5,187,462 | 2/1993 | Montean | 335/284 |
| 5,210,524 | 5/1993 | Schwarz et al. | 340/551 |
| 5,260,690 | 11/1993 | Mann et al. | 340/551 |
| 5,285,182 | 2/1994 | Zarembo | 335/284 |
| 5,341,125 | 8/1994 | Plonsky et al. | 335/284 |
| 5,493,275 | 2/1996 | Easter | 340/551 |
| 5,500,640 | 3/1996 | Zhou et al. | 340/551 |

OTHER PUBLICATIONS

3M Brochure, "3M Magnetic Media Circulation Accessories for 3M Tattle–Tape Security Strips", 1994.

3M Brochure, "3M Circulation Accessories for Nonmagnetic Media", 1995.

3M Brochure, "3M Model 995 Staff Workstation", 1995.

3M Brochure, "3M Materials Flow Management Systems, The cornerstone of a more productive, more responsive library", 1996.

*Primary Examiner*—Glen Swann

*Attorney, Agent, or Firm*—Gary L. Griswold; Walter N. Kirn; Kari H. Bartingale

[57] ABSTRACT

The present re/desensitizer is an apparatus for changing the status of a magnetic marker of an electronic article surveillance system. The markers are attached to or otherwise associated with an object to be protected, such has a book, CD, etc. The device can be set up as a resensitizer, a desensitizer, or with the inclusion of a mode switch, a combination re/desensitizer. The apparatus includes a magnetic field generator for generating a marker status changing magnetic field, detection means for detecting presence of an object, a control means for controlling the activation time of the magnetic field generator such that the marker status changing magnetic field is generated when an object is present. The magnetic field generator includes an offset core designed for continuous operation without excessive heat build up. The offset core is oriented such that the marker status changing magnetic field is substantially horizontal and adjacent to the mounting surface, thus reducing the complexity of movement of the hands and arms required when operating the device. The re/desensitizer also includes a control circuit which controls power to the magnetic field generator such that the marker status changing magnetic field is produced only when an object containing a marker is present. The control circuit also controls the duty cycle of the device by controlling the amount of time that the device is activated and by controlling the amount of time between successive activations.

20 Claims, 6 Drawing Sheets

APPARATUS FOR CHANGING THE STATUS OF MAGNETIC MARKERS IN AN ELECTRONIC ARTICLE SURVEILLANCE SYSTEM

BACKGROUND

Article inventory control systems are used to authorize, track and control movement of items into and out of a facility. An example is a library circulation control system. In this case, each user is uniquely identified by an identification card containing magnetically or optically detectable data (e.g., a barcode). The items to be tracked, books in the collection of the library, for example, have a similar identifying label such that each item is uniquely identified. A computerized database contains identification data on all registered patrons of the library and identification data on all books, videos, audiocassettes, and other items in the library's collection. When someone desires to remove an item from the library, the library circulation control system first verifies that the person is an authorized patron of the library. The system determines whether the person is authorized to check out any item, or a particular class of items. The system then determines whether the particular item can be removed from the library. Some items which the library may not want removed can include certain reference items, very rare or valuable items, or items that are on reserve. If both the user and the item are authorized by the system, the item may be removed from the library by that user. The system then updates the computerized database to indicate that the particular user has checked out the particular item at issue. The system will also give a visual or audible indication to the user that the item has been checked out, or will give an error message if either the user or the item was not authorized.

To prevent unauthorized removal of items from the facility, electronic article surveillance systems (EAS) may be employed. An EAS system usually includes an EAS marker attached to the items to be protected, a mechanism for interrogating and sensing the marker within an interrogation zone, usually located near the exit of the facility, and a mechanism for preventing unauthorized removal of the article from the facility, such as a locking exit gate or an audible alarm. When an active marker is detected within the interrogation zone, the gate is locked or the alarm is sounded, thus reducing the number of unauthorized removals from the facility.

To allow authorized removal of articles from a facility, dual status markers have been developed. The dual status markers can be deactivated to allow authorized removal, such as check out from a library or video rental store, when the item is returned, the marker can be reactivated.

Resensitizers and desensitizers are used to sensitize or desensitize dual status markers. However, existing re/desensitizers have certain drawbacks. First, many resensitizers heat up rather quickly and therefore cannot be used for long periods of time, or require a fan, which increase both the size, cost and noisiness of the resensitizer. Also, many resensitizers and desensitizers are configured in such a way to require undesirable and even harmful repetitive lifting, rotating, transfer and placement and other movements of the arms and hands of objects to be resensitized. Existing re/desensitizers also require that holes be cut in a countertop, a feature that makes them undesirable.

SUMMARY

The present re/desensitizer is an apparatus for changing the status of a magnetic marker of an electronic article surveillance system. The re/desensitizer is adapted for use with objects such as books, other printed matter, CD's or other articles to be protected. Each object includes an electronic article surveillance marker attached or otherwise associated therewith. The apparatus includes a detector which detects presence of an object, a magnetic field generator which generates a marker status changing magnetic field, and control circuitry which controls the activation time of the magnetic field generator such that the status changing magnetic field is generated when an object is detected. The apparatus can be used as a resensitizer, as a desensitizer or, with the inclusion of a mode switch, a single unit can operate in either mode.

BRIEF DESCRIPTION OF DRAWINGS

The various objects, features and advantages of the present EAS system will be fully understood upon reading and understanding the following detailed description and accompanying drawings in which.

DETAILED DESCRIPTION

Figure 1:
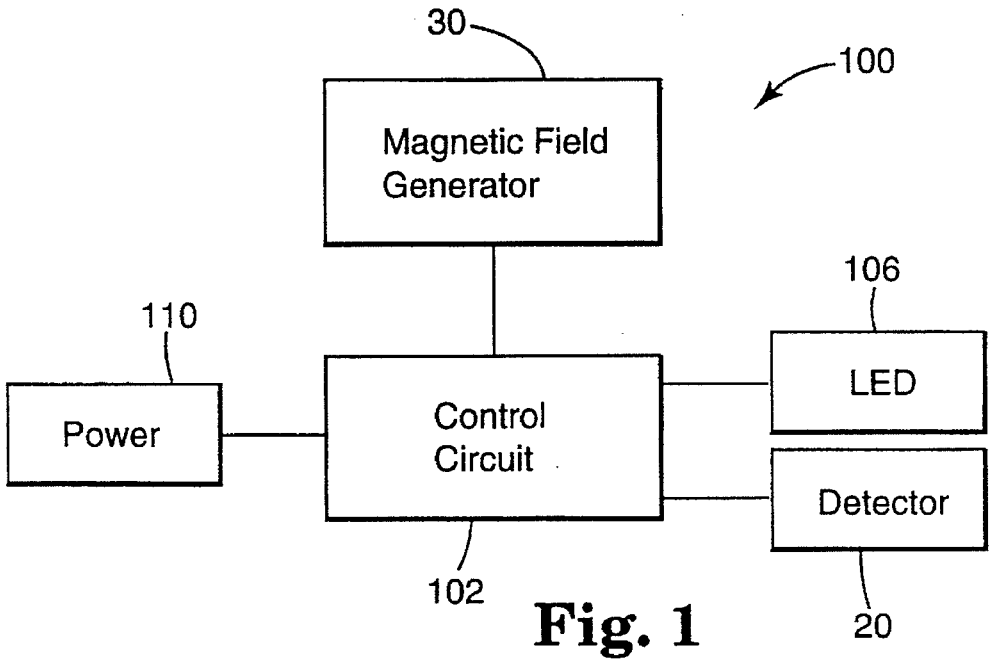
FIG. 1 shows a block diagram of the present re/desensitizer.

FIG. 1 shows a block diagram of the present re/desensitizer 100. The basic function of the re/desensitizer is to change the status of magnetic markers used in an electronic article surveillance (EAS) system. The re/desensitizer 100 can operate in either a resensitizing mode or a desensitizing mode. The re/desensitizer uses an AC magnetic field to demagnetize (i.e., sensitize) the markers and uses a rectified DC magnetic field to magnetize (i.e., desensitize) markers. The re/desensitizer 100 includes power source 110, magnetic field generator 30, LED 106, detector 108 and control circuit 102. The magnetic field generator 30 of the re/desensitizer consists of a magnetizing coil and an offset core which produce a marker status changing magnetic field. The marker status changing magnetic field can be either a sensitizing or desensitizing magnetic field, depending upon the mode the device is in. The control circuit 102 controls the magnetic field generator in such a way to allow continuous use without excessive heat build up. This allows the device to be used continuously over long periods of time and eliminates the need for a fan or other cooling device. In addition, the device is designed in such a way so that the magnetic field produced is horizontal (e.g., parallel with and adjacent to the work surface). The ergonomics of the resulting re/desensitizer are thus greatly improved in that books or other articles to which the markers are attached can be easily moved and slid past the re/desensitizer while reducing the complexity of motion of the arms and hands required by the operator.

Figure 2:
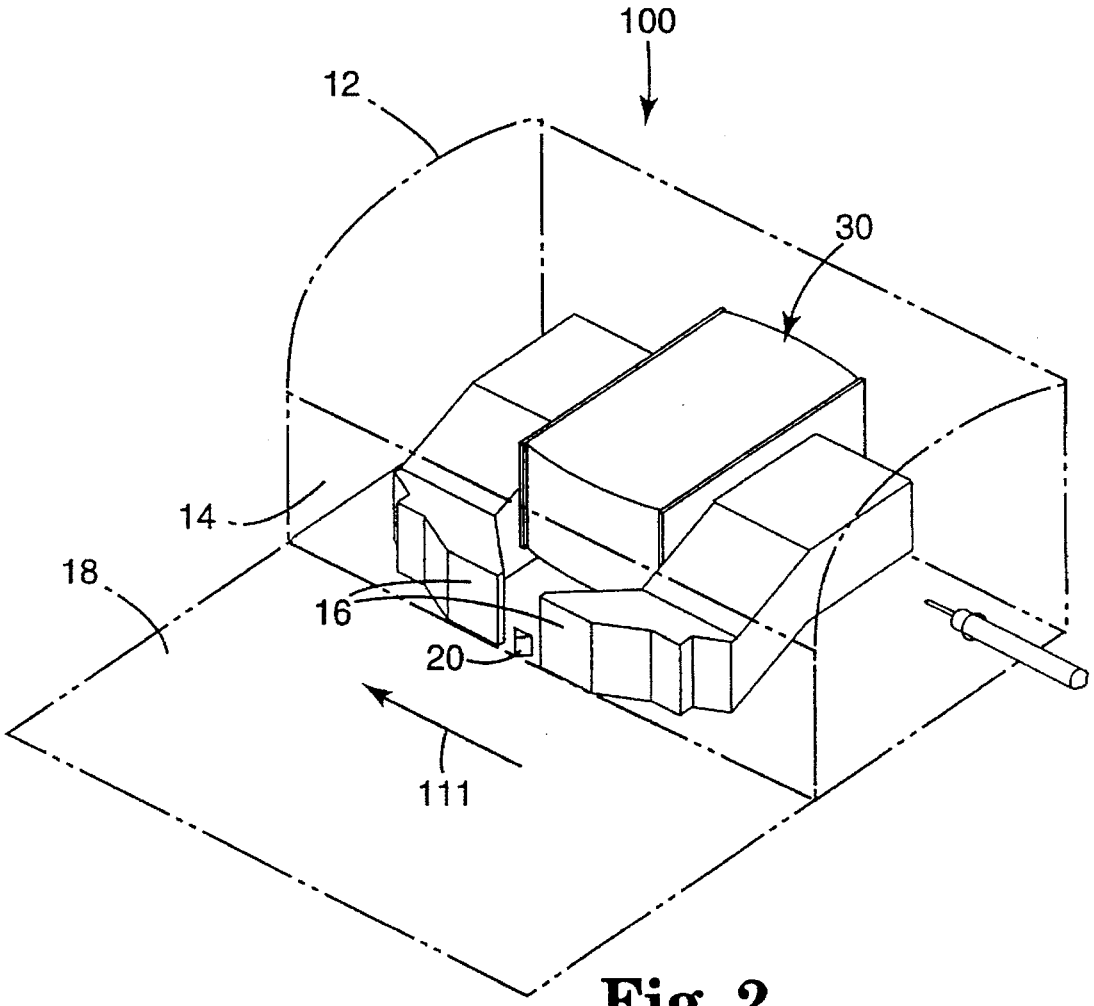
FIG. 2 shows a more detailed illustration of the present re/desensitizer.
Figure 3:
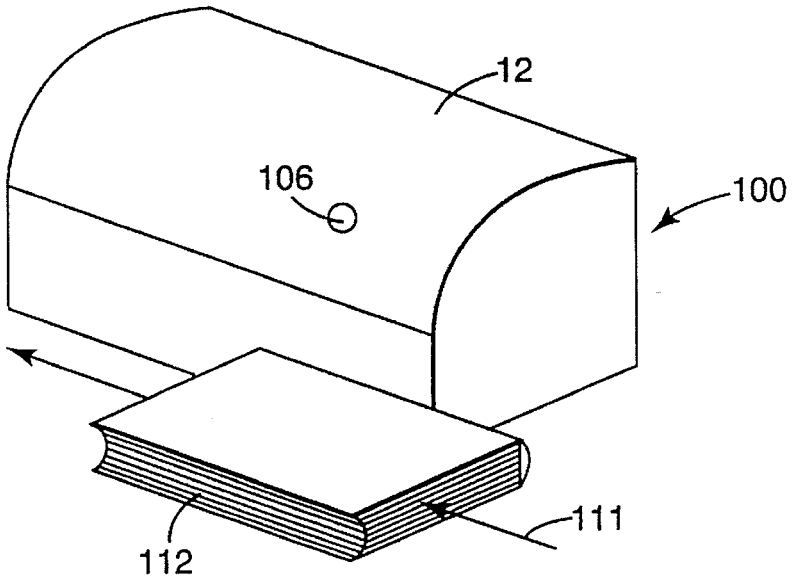
FIG. 3 shows the core of the present re/desensitizer.

A more detailed illustration of the re/desensitizer 100 is shown in FIG. 2. The re/desensitizer 100 includes a housing 12 having a substantially planar front surface 14 with an active re/desensitizing area 16, and a base surface 18 which is substantially orthogonal to surface 14. Base surface 18 may be provided as part of housing 12, or surface 18 may be a horizontal surface such as a table or bench surface onto which housing 12 is placed or is attached. In either resensitizing or desensitizing mode, objects such as book 112 with a dual-status Electronic Article Surveillance marker attached thereto or otherwise associated therewith are placed on base surface 18 with the marker positioned toward surface 14 as shown in FIG. 3. The object is translated past the active area 16 in the direction indicated by arrow 111. Detector 20, such as a photocell, and associated detection and control circuitry (shown and described below with respect to FIG. 5) detects the presence of the object in the active area. When an object is detected, AC or DC power, depending upon whether the system is in resensitizing or desensitizing mode, is applied to magnetic field generator 30 to cause the marker status changing magnetic field to be produced. The duty cycle of the re/desensitizer is controlled by control circuitry 102 (described in detail below with respect to FIG. 5).

The placement of the detector 20 plays a role in the reliability of the re/desensitizer 100. If the detector 20 is located coplanar with front surface 14, many books would be detected, although some black or dark colored books or other objects may go undetected. In a preferred embodiment, the detector 20 is angled toward the direction in which the objects approach the active area 16. In FIG. 2, objects are slid past the re/desensitizer from right to left as indicated by arrow 111. Thus, in FIG. 2, the detector is angled generally toward the right. Although the particular angle is not critical, in a preferred embodiment the detector 20 is directed toward the direction from which objects are moved past the detector at an angle of about 45°, for example. Angling the detector 20 in this way increases the likelihood that the detector 20 will detect the presence of black or other dark colored books or objects. In the case of books, the angle allows the detector 20 to "see" the ends of the pages of a book, which are generally white or light in color, thus increasing the likelihood that even a very dark colored book will be detected.

Figure 4:
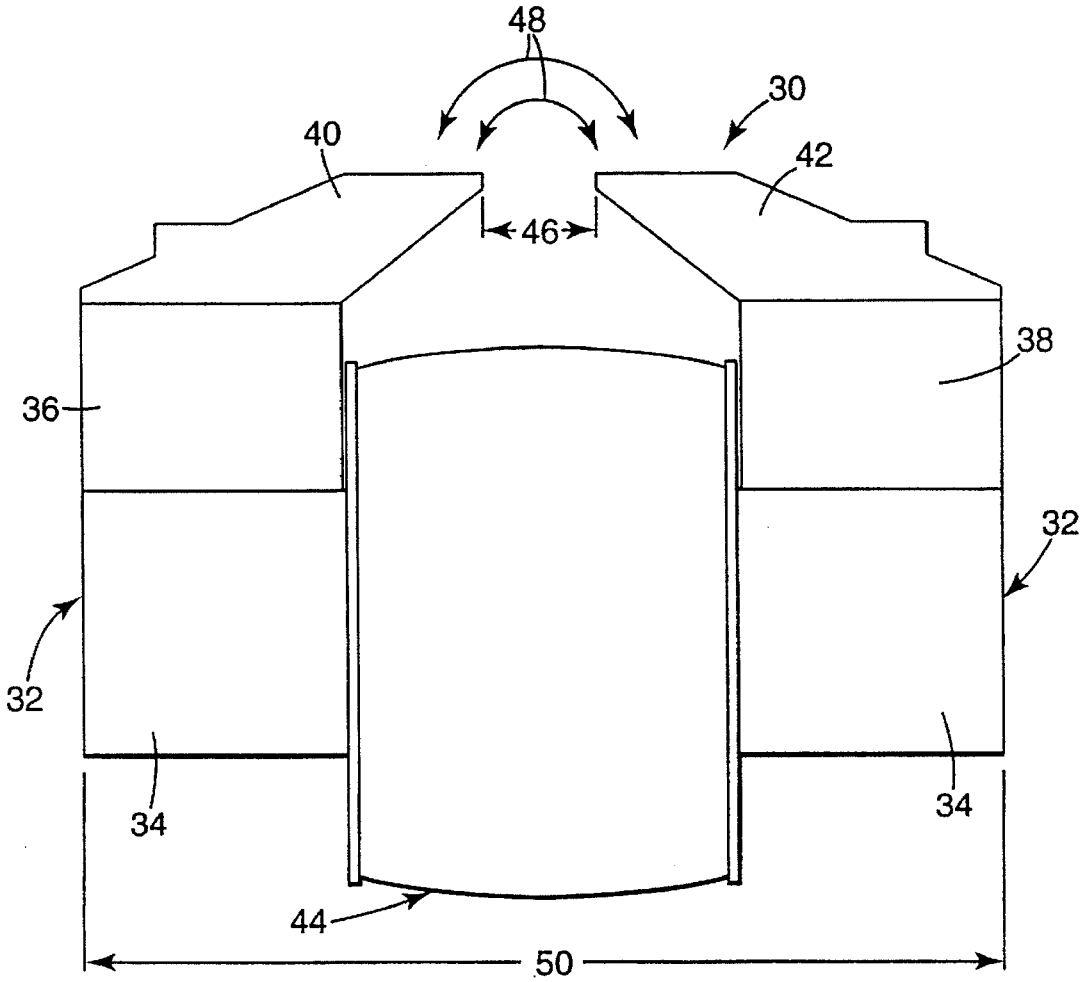
FIG. 4 shows the present re/desensitizer in use.

Referring now to FIG. 4, a top view of the magnetic field generator 30 is shown. Magnetic field generator 30 includes a magnetic core 32 having a main portion 34, offset portions 36 and 38 attached to opposite ends of main portion 34, tapered pole pieces 40 and 42 attached to offset portions 36 and 38, and a coil 44 enclosing the main portion 34 of core 32 Offset portions 36 and 38 are designed such that the front edge of each pole piece 40 and 42 is substantially parallel and adjacent with front surface 14, as shown in FIG. 2. Offset portions 36 and 38 are offset or angled down about 1.1 inches (2.79 cm) from the main portion 34 to allow the bottoms of the offset portions 36 and 38 to lie flat on the surface 18, as can be seen more clearly in FIG. 2. When electrical current is present in coil 44, a magnetic field is applied to main portion 34 of core 32, producing a magnetic flux density which extends continuously through all portions 34, 36, 38, 40 and 42, of core 32 and across the gap 46 between the tips of pole pieces 40 and 42. The direction of the marker status changing magnetic field, in this case a resensitizing magnetic field, in the active re/desensitizing area 16, which is generally adjacent and between the tips of pole pieces 40 and 42, is shown by double headed arrows 48. When the device is in resensitizing mode, an alternating current is present in coil 44, and the marker status changing magnetic fields illustrated by arrows 48 are continuously reversing in direction corresponding to the direction of current flow in coil 44. When the device is in desensitizing mode, a DC current is applied to coil 44, and the marker status changing magnetic field, in this case a desensitizing magnetic field, will be in one direction only.

All portions 34, 36, 38, 40 and 42, of core 32 preferably consist of a high permeability, high saturation induction magnetic material that is low in electrical conductivity so that relatively small electrical currents produce magnetic fields 48 of adequate magnitude for resensitization, and so that eddy current and hysteresis losses will be small enough to avoid excessive heating of the core.

In one preferred embodiment of the re/desensitizer 100, all portions 34, 36, 38, 40 and 42, of core 32 are molded from sintered iron powder blocks, available from Micrometals Corp., Anaheim, Calif. as Material No. 26, having a permeability of about 75. The portions can be molded separately or as a single unit. The main portion 34 of core 32 preferably has cross-section dimensions of about 4.45 cm (1.75 in.) by 4.45 cm (1.75 in.), and extends 15.7 cm (6.18 in.) along dimension 50. Offset portions 36 and 38 preferably have dimensions 3.18 cm (1.25 in.) deep by 4.45 cm (1.75 in.) wide×7.16 cm (2.82 in.) high. Offset portions 36 and 38 are preferably offset or angled down from the main portion 34 about 2.79 cm (1.1 in.). Tapered pole pieces 40 and 42 preferably have dimensions 2.18 cm (0.86 in.) deep by 6.98 cm (2.75 in.) wide by 5.72 cm (2.25 in.) high. The gap between the pole pieces is preferably 1.90 cm (0.75 in.). Coil 44 enclosing main portion 34 of core 32, and extending 6.65 cm (2.62 in.) along its length, preferably includes two separate sets (not shown) of windings each having 400 turns of 18 gauge (1.0 mm diameter) copper wire. When the re/desensitizer is used with 100/120 V, 60 Hz AC power, the two windings are connected in parallel. When the re/desensitizer is used with 220/240 V, 50 Hz AC power, the two windings are connected in series. In either embodiment, alternating currents of about 5 amps at 120 V and 2.5 amps at 240 V (i.e., 600 watts) are used in all turns of coil 44, when the re/desensitizer is in resensitizing mode.

The design of magnetic field generator 30 provides several advantages. By increasing the width of the main portion 34 of the core and by tailoring the shape of the pole pieces 40 and 42, a number of advantages are achieved. First, because of the distance between the flux carrying part of the main portion 34 of the core, very little flux leakage occurs, thus maximizing the flux across the tips of the pole pieces 40 and 42. Second, because of the geometry of the coil verses the geometry of the core, the current density at any one spot is low enough so that temperature rise in the core is minimized. The example re/desensitizer has been demonstrated to be capable of continuous operation without developing excessive heat buildup. Third, because of the offset shape of the core provided by offset portions 36 and 38, the core can be oriented in a housing (see FIG. 2) such that the resulting magnetic field is horizontal, e.g., parallel and adjacent to the surface 18 (see FIG. 2) on which the device is placed. The horizontal field allows books or other articles to which magnetic markers are attached to be slid by the re/desensitizer as shown in FIG. 3, to minimize the repetitive lifting, rotating, and other movements of the hands, wrists and arms, thus reducing the associated repetitive motion discomfort experienced by the operator.

Figure 5A:
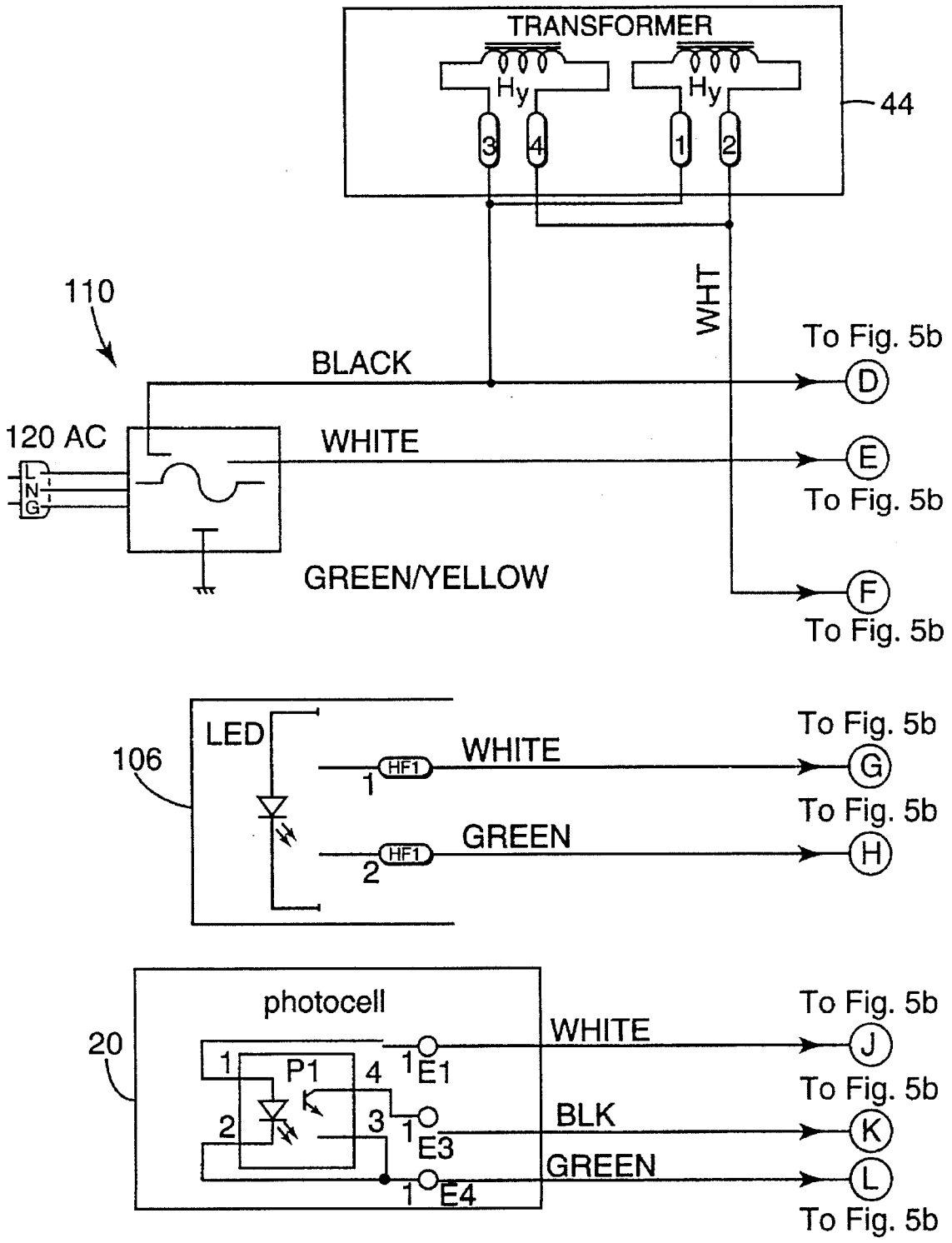
FIGS. 5A, 5B, 5C and 5D show an electrical schematic diagram of the control circuitry.
Figure 5B:
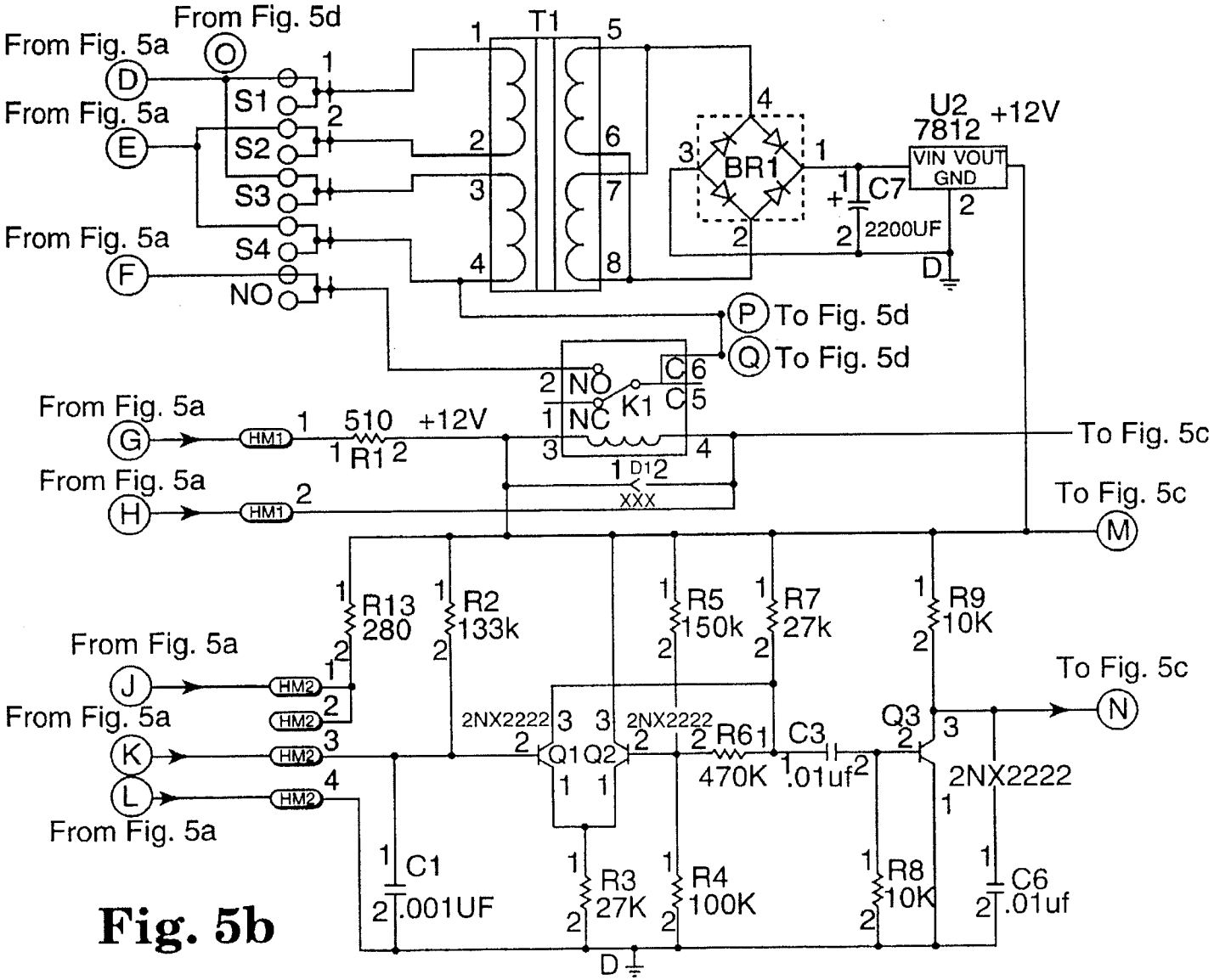

FIGS. 5A, 5B and, 5C and 5D show an electrical schematic diagram of the control circuit 102. FIG. 5D shows optional mode switch. To allow the user to choose between operation as a resensitizer and a desensitizer the mode switch should be connected at connector bubbles O, P and Q of FIG. 5B. When in the desensitize mode, the mode switch causes a rectified DC voltage of approximately 4–12 volts to be applied to the magnetizing coils 44. When in the resensitize mode, the mode switch causes a 120 volt AC voltage to be applied to the magnetizing coils 44.

Figure 5C:
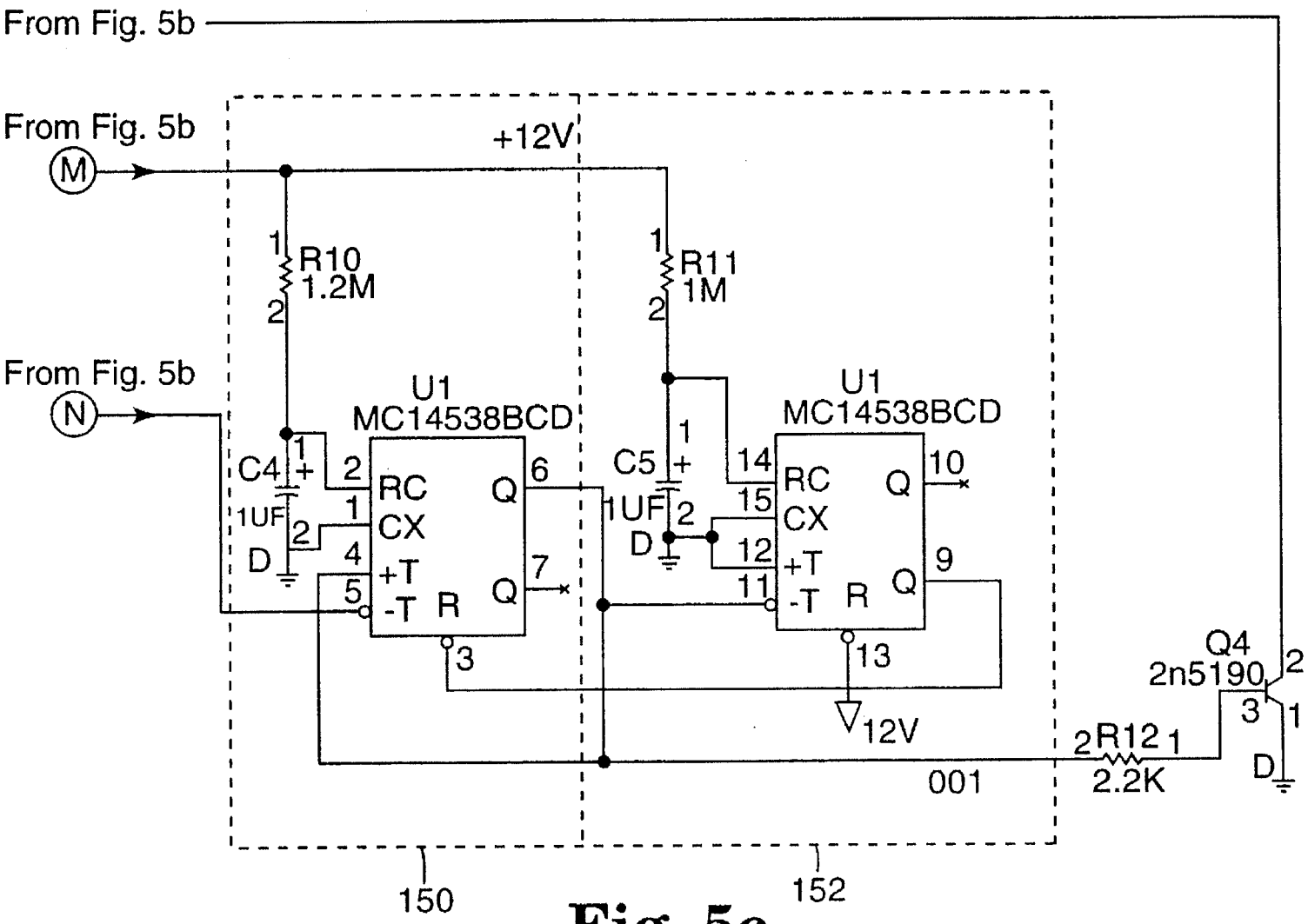
Figure 5D:
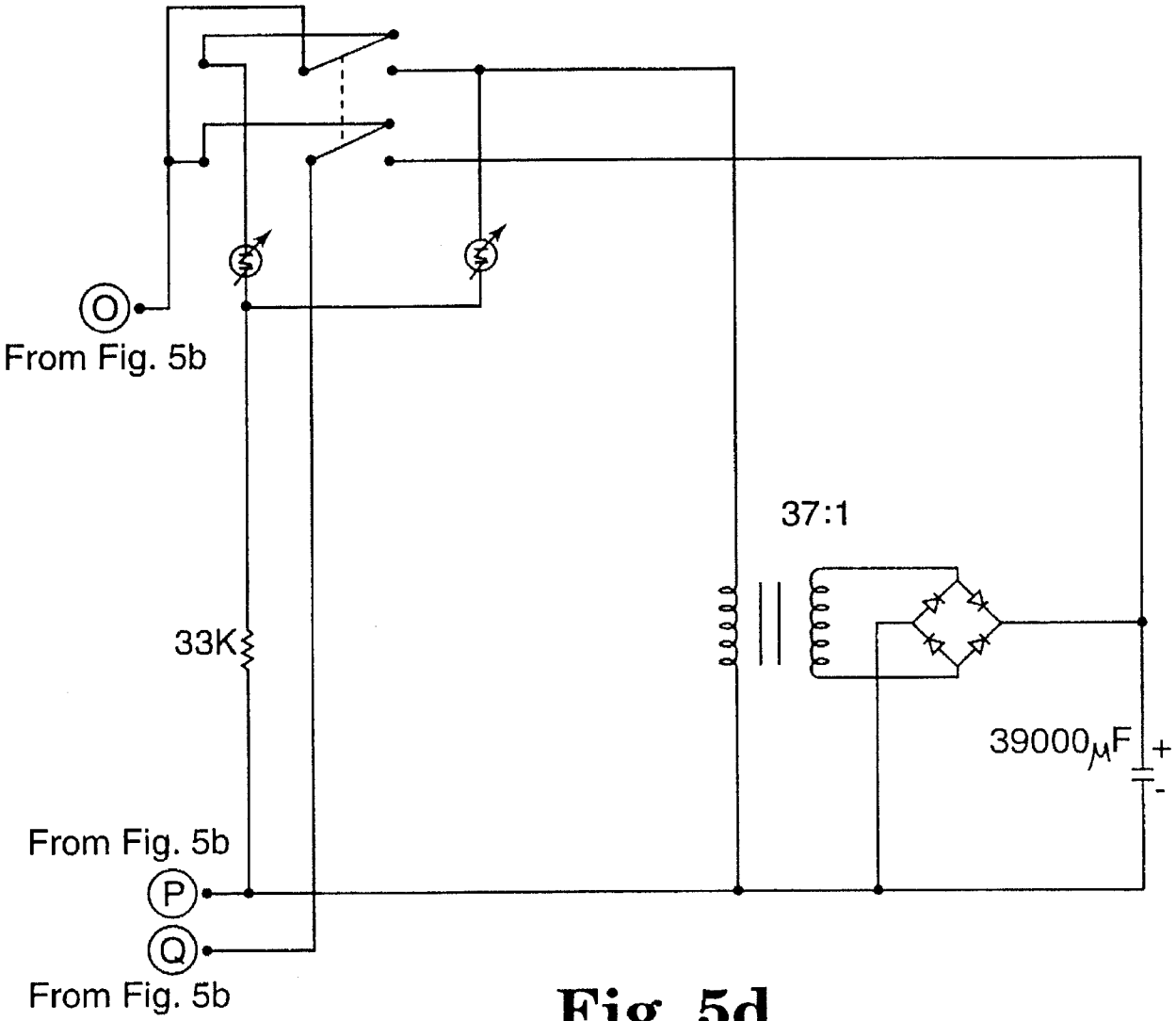

If the circuit is to be used as a resensitizer only, the mode switch of FIG. 5D is deleted, and FIGS. 5A, 5B and 5C are connected through the corresponding connector bubbles. No additional connection is made at bubble O of FIG. 5B. Although it is not shown, those of skill in the art will also readily recognize that the circuit could also be connected as a desensitizer only, without departing from the scope of the present invention.

The control circuit 102 serves two primary purposes. First, the control circuit 102 controls power to the magnetizing coil 44 such that a magnetic field is generated only when an object is detected by the detector 20. In other words, the marker status changing magnetic field is generated only when an objected is detected. Thus, a field is not unnecessarily generated when no object is present and thus no marker to be changed. Control circuit 102 activates the re/desensitizer 100 when an object such as a book blocks detector 20. A detector block causes power to be applied through switch K to the magnetizing coil 44. When power is applied, LED 106 is illuminated (see FIG. 3), indicating that the device is active and that the resensitizing or desensitizing magnetic field is being generated. Since a field is generated only when an object to be re/desensitized is present in the preferred embodiment, current density and the associated temperature increase in the core are reduced. Also, unnecessary exposure to magnetic fields of persons near the re/desensitizer is reduced.

The second function of control circuit 102 is to control the duty cycle of the re/desensitizer. That is, control circuit 102 controls both the amount of time that the device is activated (e.g., that power is applied to the magnetizing coil) once an object is detected, and also controls the amount of time that the circuit must be off between successive activations. Dual timers U1 and associated circuit components shown in FIG. 5B control the duty cycle of the re/desensitizer.

A "time on" circuit 150 includes timer U1, resistor R10 and capacitor C4. The time on circuit is triggered by a block of detector 20 indicating that an object is present in the active area. The time on circuit 150 controls the length of time that power is applied to the magnetizing coil 44. Adjustment of resistor R10 allows the time on to be varied as desired for the particular application.

Similarly, a "time off" circuit 152 including timer U1, resistor R11 and capacitor C5 control the amount of time between successive activations of the magnetic field generator. In other words, the time off circuit 152 controls the minimum amount of time after an activation of the magnetic field generator that power cannot be applied to the magnetizing coil. After the required period of time controlled by the time on circuit, the time off circuit 152 is triggered. Power cannot be applied until after the "time off" period, as determined by the time off circuit 152, has elapsed. To retrigger the circuit, the detector must be unblocked and then reblocked. Adjustment of resistor R11 allows the "time off" to be varied as desired to adjust the duty cycle.

The time on circuit 150 and time off circuit 152 allow the duty cycle, defined as the percentage of total cycle time that power is applied, to be controlled from anywhere between 0 and 100%. More preferably, the duty cycle is in the range of 30–60%, and even more preferably 40–50%. In a preferred embodiment, the time on and time off circuits are set to provide a duty cycle of approximately 45%. This corresponds to the amount of time that the coil is active during a typical resensitizing or desensitizing cycle, taking into account the physical movements which must be made by the operator such as picking up a book, sliding it past the device, putting the book down, picking up a second book, etc. It has been found that a duty cycle 30–60% is sufficient to ensure that an operator will not have to wait while operating the device. This duty cycle also helps reduce temperature increase in the magnetic core since power is not continuously applied, thus further eliminating the need for a fan or other cooling device. This duty cycle also ensures that the marker status will be changed even when an operator moves the object past the active area at a high speed, e.g. 66 to 71 cm/s (26 to 28 inches/s), and minimizes power consumption and reduces unnecessary operator exposure to magnetic fields.

The value of resistor R2 determines the sensitivity of the detector 20. The sensitivity is preferably adjusted so that shadows cast onto the detector (such as by the close presence of an operator, changes in lighting, etc.) do not cause power to be applied to the coil.

Although specific embodiments have been shown and described herein for purposes of illustration of exemplary embodiments, it will be understood by those of ordinary skill that a wide variety of alternate and/or equivalent implementations designed to achieve the same purposes may be substituted for the specific embodiments shown and described without departing from the scope of the present invention. Those of ordinary skill will readily appreciate that the present invention could be implemented in a wide variety of embodiments, including various hardware and software implementations, or combinations thereof. This application is intended to cover any adaptations or variations of the preferred embodiments discussed herein. Therefore, it is intended that this invention be defined by the claims and the equivalents thereof.

We claim:

1. An apparatus for changing the status of a magnetic marker associated with an object, wherein the marker is attached to or otherwise associated with an object to be protected, comprising:

detection means for detecting presence of the object and for producing therefrom an object detected signal;

a magnetic field generating means for generating a marker status changing magnetic field; and control means for controlling an activation time of the magnetic field generating means in response to the object detected signal, and for controlling a time between successive activations of the magnetic field generating means;

wherein movement of the object through the marker status changing magnetic field causes a change in the status of the marker.

2. The apparatus of claim 1 further including means for setting the sensitivity of the detection means.

3. The apparatus of claim 1 wherein the detection means comprises a photocell angled toward the direction from which the object is moved through the marker status changing magnetic field.

4. The apparatus of claim 1 wherein the control means includes:

a time on control, adapted to control application of power to the magnetic field generating means in response to the object detected signal, the time on circuit further adapted to control the activation time of magnetic field generating means; and a time off control, adapted to control the time between successive activations of the magnetic field generating means;

such that the time on control and the time off control operate to control the duty cycle of the magnetic field generating means.

5. The apparatus of claim 4 wherein the duty cycle is about 30–60%.

6. The apparatus of claim 5 wherein the duty cycle is about 45%.

7. The apparatus of claim 1 wherein the control means further includes means for adjusting the activation time of the magnetic field generating means.

8. The apparatus of claim 7 wherein the control means further includes means for adjusting the time between successive activations of the magnetic field generating means.

9. The apparatus of claim 1 wherein the magnetic field generating means comprises:

a magnetic core, including:

a main portion;

two offset portions, each offset portion sloping downwardly from the main portion; and two pole pieces, each associated with a different one of the offset portions, wherein each pole piece is connected at a first end to its associated offset portion, such that second ends of the pole pieces are positioned to provide a gap therebetween across which the marker status changing magnetic field is generated; and a magnetizing coil wrapped around the magnetic core, such that when current is applied to the magnetizing coil, magnetic flux is induced in the magnetic core thus generating the marker status changing magnetic field.

10. The apparatus of claim 9 wherein the marker status changing magnetic field is a marker resensitizing magnetic field.

11. The apparatus of claim 9 wherein the marker status changing magnetic field is a marker desensitizing magnetic field.

12. An apparatus for changing the status of a magnetic marker, comprising:

detection means for detecting presence of an object and for producing therefrom an object detected signal, the object having a marker associated therewith;

a magnetic field generating means for generating a marker status changing magnetic field, wherein the magnetic field generating means includes:

a magnetic core, including:

a main portion;

two offset portions sloping downwardly from the main portion; and two pole pieces, each associated with a different one of the offset portions, wherein each pole piece is connected at a first end to its associated offset portion, such that second ends of the pole pieces are positioned to provide a gap therebetween across which the marker status changing magnetic field is generated; and a magnetizing coil wrapped around the magnetic core, such that when power is applied to the magnetizing coil, magnetic flux is induced in the magnetic core thus generating the marker status changing magnetic field; and control means, responsive to the object detected signal, for controlling power to the magnetic field generating means, such that the status changing magnetic field is generated when an object is detected;

wherein the marker status changing magnetic field operates to change the status of the marker.

13. The apparatus of claim 12 further including a mode switch adapted to switch the apparatus between a marker resensitizing mode and a marker desensitizing mode.

14. The apparatus of claim 12 wherein when an AC current is applied to the magnetizing coil, the marker status changing magnetic field is a marker resensitizing magnetic field.

15. The apparatus of claim 12 wherein when an DC current is applied to the magnetizing coil, the marker status changing magnetic field is a marker desensitizing magnetic field.

16. The apparatus of claim 12 wherein the magnetic field generating means is oriented in a housing such that the marker status changing magnetic field is substantially horizontal and adjacent to a surface on which the apparatus is placed.

17. The apparatus of claim 12 wherein each of the pole pieces is tapered toward the second end.

18. The apparatus of claim 17 wherein the second ends of the pole pieces extend toward each other.

19. The apparatus of claim 12, wherein the control means is further for controlling an activation time of the magnetic field generating means.

20. The apparatus of claim 12, wherein the control means is further for controlling a time between successive activations of the magnetic field generating means.

* * * * *

UNITED STATES PATENT AND TRADEMARK OFFICE

CERTIFICATE OF CORRECTION

PATENT NO.: 5,625,339

DATED: April 29, 1997

INVENTOR(S): Peter J. Zarembo et al.

It is certified that error appears in the above-identified patent and that said Letters Patent is hereby corrected as shown below:

Title page, [57] ABSTRACT, line 4, delete "has" and insert therefore –as--.

Column 4, line 55, delete "and," before "5C".

Column 4, line 56, insert –an—after the word "shows".

Column 5, line 11, delete "objected" and insert therefore –object--.

Column 5, line 16, delete "K" and insert therefore –K1--.

Column 5, line 31, delete "U1 and" and insert therefore –U1A and U1B and--.

Column 5, line 33, delete "U1" and insert therefore –U1A--.

Column 5, line 41, delete "U1" and insert therefore –U1B--.

Column 8, line 26, claim 15, line 1, delete "an" and insert therefore –a--.

Signed and Sealed this

Tenth Day of February, 1998

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,625,339

DATED : April 29, 1997

INVENTOR(S) : Peter J. Zarembo, Philip E. Edstrom, Anthony M. Belka, Dennis L. Sando, William R. Weber, III and Mark R. Crelin It is certified that error appears in the above-indentified patent and that said Letters Patent is hereby corrected as shown below:

Title page, [22] Filed: "Jan. 11, 1996" should read --Jan. 8, 1996--.

Signed and Sealed this

Sixth Day of April, 1999

*Attest:*

*Attesting Officer*

Q. TODD DICKINSON

*Acting Commissioner of Patents and Trademarks*